US011188029B2

(12) United States Patent
Lagorgette

(10) Patent No.: US 11,188,029 B2
(45) Date of Patent: Nov. 30, 2021

(54) DEVICE FOR SELECTING A COMBINATION OF PATTERNS AND TIMEPIECE COMPRISING SUCH A DEVICE

(71) Applicant: ETA SA Manufacture Horlogere Suisse, Grenchen (CH)

(72) Inventor: Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 546 days.

(21) Appl. No.: 16/172,997

(22) Filed: Oct. 29, 2018

(65) Prior Publication Data

US 2019/0146413 A1 May 16, 2019

(30) Foreign Application Priority Data

Nov. 16, 2017 (EP) ..... 17202163

(51) Int. Cl.
*G04B 19/253* (2006.01)
*G04B 19/04* (2006.01)
(Continued)

(52) U.S. Cl.
CPC ..... *G04B 19/25333* (2013.01); *G04B 19/046* (2013.01); *G04B 19/202* (2013.01); *G04C 17/005* (2013.01)

(58) Field of Classification Search
CPC ..... G04B 19/046; G04B 19/202; G04B 19/25333; G04C 17/005; G09F 11/04; G09F 11/23; G09F 11/232
(Continued)

(56) References Cited

U.S. PATENT DOCUMENTS 4,257,113 A 3/1981 Meister et al.
2002/0159337 A1* 10/2002 Weissbach ..... G04B 19/2536 368/37
(Continued)

FOREIGN PATENT DOCUMENTS

CH 190208 4/1937
CN 1106938 A 8/1995
(Continued)

OTHER PUBLICATIONS

European Search Report dated Jun. 11, 2018 in European Application 17202163.6, filed on Nov. 16, 2017 (with English Translation of Categories of Cited Documents).
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A device for selecting a combination of patterns for a timepiece, including an inner disc including N angular sectors of the same size, each bearing a symbol on its periphery, with N being a whole number greater than 1; an outer disc coaxial to the inner disc and with a larger diameter, the outer disc bearing M symbols distributed over M*N angular sectors of the same size, with M being a whole number greater than 1, each of the M symbols of the outer disc being repeated on N consecutive sectors of the outer disc; a dial extending opposite the inner disc, the dial including an aperture allowing a pattern of the inner disc to be matched with a pattern of the outer disc; an activation device allowing the inner disc to rotate and a meshing device coupling the two discs according to a speed reducing ratio M.

13 Claims, 2 Drawing Sheets

(51) Int. Cl.
*G04C 17/00* (2006.01)
*G04B 19/20* (2006.01)

(58) Field of Classification Search
USPC ..... 40/113, 114, 495
See application file for complete search history.

(56) References Cited

U.S. PATENT DOCUMENTS

| | | | | |
|---|---|---|---|---|
| 2003/0103417 | A1* | 6/2003 | Gabathuler ..... | G04B 19/2536 368/37 |
| 2005/0088917 | A1 | 4/2005 | Dalloz | |
| 2005/0169109 | A1 | 8/2005 | Watanabe | |
| 2008/0279049 | A1* | 11/2008 | Schmiedchen .. | G04B 19/25386 368/37 |
| 2009/0154296 | A1 | 6/2009 | Behling et al. | |
| 2014/0301170 | A1 | 10/2014 | Tran et al. | |

FOREIGN PATENT DOCUMENTS

| | | | |
|---|---|---|---|
| CN | 101114155 | A | 1/2008 |
| CN | 101251745 | A | 8/2008 |
| CN | 101531102 | A | 9/2009 |
| EP | 1 526 415 | A1 | 4/2005 |
| JP | 52-11 4369 | A | 9/1977 |
| JP | 55-138677 | A | 10/1980 |
| JP | 11-166982 | A | 6/1999 |
| JP | 2009-508097 | A | 2/2009 |
| JP | 2013-167518 | A | 8/2013 |
| WO | WO 2012/127055 | A1 | 9/2012 |

OTHER PUBLICATIONS

Notice of Reasons for Refusal dated Jun. 23, 2020 in Japanese Patent Application No. 2018-212734 (with English translation), 9 pages.

Combined Chinese Office Action and Search Report dated May 29, 2020 in Patent Application No. 201811366813.7 (with English translation of Categories of Cited Documents), 8 pages.

Notice of Final Rejection dated Sep. 1, 2020 in Korean Patent Application No. 10-2018-0137231 (with English translation), 6 pages.

Chinese Office Action dated Feb. 2, 2021 in Chinese Patent Application No. 201811366813.7, 3 pages.

Office Action dated Feb. 2, 2021 in corresponding Chinese Patent Application No. 201811366813.7; 3 pages.

Notice of the Reason for Refusal dated Feb. 9, 2021 in Japanese Patent Application No. 2018-212734 (with English language translation), 7 pages.

* cited by examiner

DEVICE FOR SELECTING A COMBINATION OF PATTERNS AND TIMEPIECE COMPRISING SUCH A DEVICE

CROSS-REFERENCE TO RELATED APPLICATION

This application claims priority to European Patent Application No. 17202163.6 filed on Nov. 16, 2017, the entire disclosure of which is hereby incorporated herein by reference.

FIELD OF THE INVENTION

The invention relates to the field of devices for selecting functions represented by patterns, for example, by logos. Such a device particularly can be integrated in a timepiece of the wristwatch type and can be used, for example, within the context of bank payments.

BACKGROUND OF THE INVENTION

Payment watches have recently been introduced on the market, opening up a new era for credit payments, making payment of small purchases quicker and more practical than searching through pockets for money. Such a watch is conventionally provided with a device for selecting a combination of payment options, each option being represented, for example, by a pattern (or logo). It is thus possible, for example, to select and display a bank card type (Visa, MasterCard, etc.), a bank account type (household expenses account, personal expenses account, etc.), etc.

For aesthetic and/or economising reasons, avoiding the use of a screen is preferable. Indeed, liquid crystal (LCD) screens have a limited aesthetic finish, whereas organic light-emitting diode (OLED) screens or screens using similar technology are expensive and consume a significant amount of power. Furthermore, a screen affects the overall aesthetic of a watch, giving it a less watch-like appearance, which can be unappealing.

SUMMARY OF THE INVENTION

The aim of the present invention therefore is to propose a device for selecting patterns that does not comprise a display screen and is simple and inexpensive to produce.

According to a first aspect, the invention relates to a device for selecting a combination of patterns, particularly for a timepiece, comprising:

- a first disc, called inner disc, the inner disc comprising N angular sectors of the same size, each of the N angular sectors bearing a symbol on its periphery, a symbol being defined as a pattern or a lack of a pattern, with N being a whole number greater than 1;
- a second disc, called outer disc, coaxial to the inner disc and having a larger diameter than the inner disc, the outer disc bearing M symbols distributed over MSN angular sectors of the same size, with M being a whole number greater than 1, each of the M symbols of the outer disc being repeated on N consecutive sectors of the outer disc;
- a dial extending opposite the inner disc, the dial comprising an aperture allowing a pattern of the inner disc to be matched with a pattern of the outer disc;
- activation means allowing the inner disc to be set into rotation and meshing means coupling the two discs according to a speed reducing ratio M.

The device according to the invention is a dual-disc coaxial counter inspired from the operating principle of an hour and minutes counter. The outer disc rotates more slowly than the inner disc, it is similar to an hour wheel. The inner disc is, for its part, similar to a minutes wheel. However, it is to be noted that the speed reducing ratio between the inner disc and the outer disc does not necessarily equal 12, as is the case for a conventional hour/minutes counter. The speed reducing ratio depends on the number of patterns on the discs and on the location of these patterns.

As is the case for an hour/minutes counter, a complete rotation of the inner disc causes a rotation of the outer disc that is dependent on the speed reducing ratio. If the speed reducing ratio equals 2, then a complete rotation of the inner disc causes a semi-rotation of the outer disc. If the speed reducing ratio equals 4, then a complete rotation of the inner disc causes a quarter turn rotation of the outer disc. In general, a speed reducing ratio equal to M means that a 360° rotation of the driving disc (in this case, the inner disc) causes a 360/M° rotation of the driven disc (in this case, the outer disc).

Given that the inner disc comprises N symbols, that the outer disc comprises M symbols, that each of the M symbols of the outer disc is repeated N consecutive times, and that the speed reducing ratio equals M:

- to change the symbol of the outer disc facing the aperture without changing the symbol of the inner disc facing the aperture, the inner disc simply needs to be rotated by 360°;
- to change the symbol of the inner disc facing the aperture without changing the symbol of the outer disc facing the aperture, the inner disc simply needs to be rotated by 360/N°.

According to a second aspect, the invention relates to a device for selecting a combination of patterns, particularly for a timepiece, comprising:

- a first disc, called inner disc, the inner disc comprising N angular sectors of the same size, each of the N angular sectors bearing a symbol on its periphery, a symbol being defined as a pattern or a lack of a pattern, with N being a whole number greater than 1;
- a second disc, called outer disc, coaxial to the inner disc and having a larger diameter than the inner disc, the outer disc bearing M symbols distributed over M*N angular sectors of the same size, with M being a whole number greater than 1, each of the M symbols of the outer disc being repeated on N consecutive sectors of the outer disc;
- a dial extending opposite the inner disc, the dial comprising an aperture allowing a pattern of the inner disc to be matched with a pattern of the outer disc;
- activation means allowing the outer disc to be set into rotation and meshing means coupling the two discs according to a speed increasing ratio M.

The difference with the invention according to the first aspect is that the driving disc is the outer disc and the driven disc is the inner disc, the meshing ratio between the driving disc and the driven disc therefore is no longer a speed reducing ratio but is a speed increasing ratio.

In the selection devices according to the first aspect or the second aspect, the activation means and the meshing means allow the inner and outer discs to be set into rotation together. The activation means are activated by an electric motor, for example. Thus, having to use a plurality of motors for separately setting the outer and inner discs into rotation is avoided. By virtue of the invention, space and weight are saved by reducing the number of motors required to operate the display device. These savings are particularly advantageous for a timepiece.

The device according to the first aspect or the second aspect can comprise the following additional features, taken individually or according to all the possible technical combinations.

In one embodiment of the first aspect or of the second aspect, N equals at most 5, advantageously two or three.

Given that each symbol of the outer disc is repeated N times, the greater the number of symbols on the inner disc, the larger the outer disc.

In one embodiment of the first aspect or of the second aspect, M equals at most 5, advantageously two or three.

The greater the number of symbols on the outer disc, the larger the outer disc, as long as each symbol of the outer disc is repeated N times.

In one embodiment of the first aspect or of the second aspect, the N symbols of the inner disc and the M symbols of the outer disc are all different.

This allows the device to be used in an optimal manner, by proposing a maximum number of combinations of the symbols of the inner disc and of the outer disc.

In one embodiment of the first aspect or of the second aspect, the symbols of the inner disc and the symbols of the outer disc each form a half-image, with a symbol of the inner disc facing a symbol of the outer disc forming a complete image.

The device according to the first aspect or the second aspect comprises a single motor for together activating the inner and outer discs via the meshing means and the activation means.

The invention also relates to a timepiece, particularly a payment watch, comprising such a device for selecting patterns.

BRIEF DESCRIPTION OF THE DRAWINGS

Further features and advantages will become clearly apparent from the following description, which is provided by way of a non-limiting example, with reference to the accompanying drawings, in which.

DETAILED DESCRIPTION OF THE PREFERRED EMBODIMENTS

Figure 1:
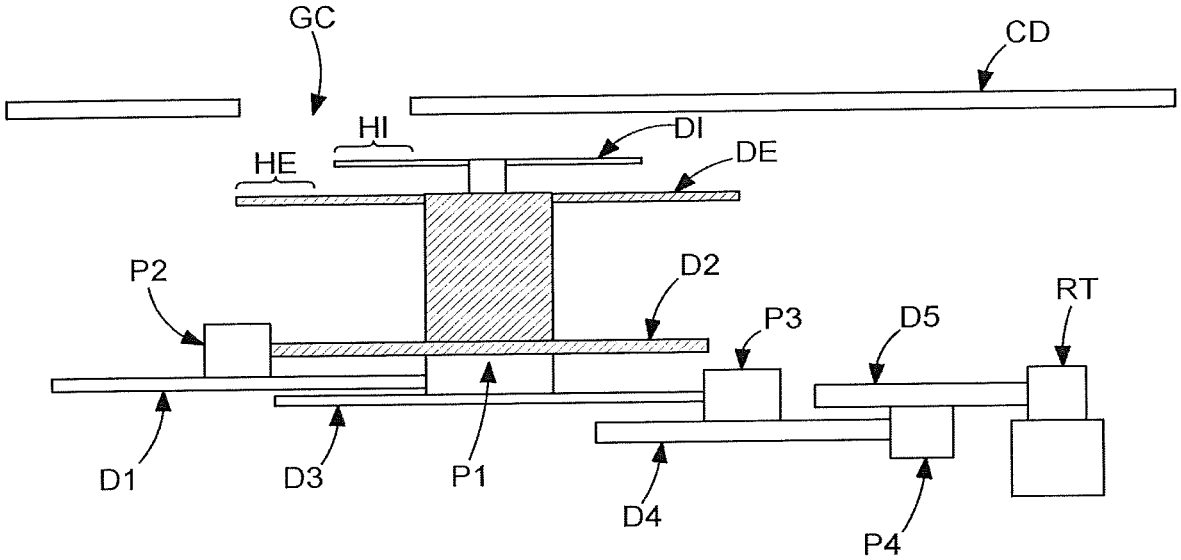
- FIG. 1 is a side view of the device for selecting a combination of patterns, according to the first aspect of the invention

FIG. 1 shows a device for selecting patterns, particularly for a timepiece, according to a first aspect of the invention. The device comprises:

- a first disc, denoted inner disc DI
- a second disc, denoted outer disc DE, coaxial to the inner disc DI and having a larger diameter than the inner disc DI.
- a dial CD comprising an aperture GC, i.e. a through-hole, the dial CD being disposed so that the inner disc DI is located between the dial CD and the outer disc DE.

Since the outer disc DE has a larger diameter than the inner disc DI, an annular peripheral portion HE of the outer disc DE is located facing the dial CD. Patterns are shown on this portion. Similarly, patterns are shown on an annular peripheral portion HI of the inner disc DI. Each disc DI, DE comprises at least two different patterns. "Symbol" refers to a pattern or a space without a pattern (also called: a void Ø). Each angular sector thus bears a symbol. The aperture GC is arranged so as to be located facing a symbol of the inner disc DI and a symbol of the outer disc DE, so that they can be matched. Therefore, a combination of two symbols can be seen through the aperture GC.

The device further comprises:

- means for activating the inner disc DI, allowing the inner disc DI to be rotated by a desired angle. This involves, for example, an assembly comprising, for example, an operable rod (not shown), a disc D1 that can be driven by the rod and a pinion P1 meshing with the disc D1 and constrained to rotate with the inner disc DI,
- means for meshing between the inner disc DI and the outer disc DE, so as to impose a speed reducing ratio between the inner disc DI (driving) and the outer disc DE (driven). This involves, for example, an assembly comprising the pinion P1, the disc D1, a pinion P2 constrained to rotate with the disc D1 and a disc D2 meshing with the pinion P2 and constrained to rotate with the outer disc DE.

Furthermore, the inner disc DI of the selection device is connected, via a chain comprising discs and pinions, to a rotor RT of an electric motor. The chain comprises, for example, a disc D3 constrained to rotate with the inner disc DI, a pinion P3 meshing with the disc D3, a disc D4 constrained to rotate with the pinion P3, a pinion P4 meshing with the disc D4 and a disc D5 constrained to rotate with the pinion P4. The motor thus allows the inner and outer discs to be set into rotation together. A single motor is sufficient for activating the two discs.

According to the invention, the inner disc DI bears N symbols distributed over N angular sectors that are the same size as its peripheral portion HI, with each angular sector bearing a symbol. The outer disc DE, for its part, bears M symbols distributed over MSN angular sectors that are the same size as its peripheral portion HE. Each of the M symbols is repeated on N consecutive angular sectors.

Furthermore, the speed reducing ratio between the driving disc (the inner disc DI) and the driven disc (the outer disc DE) equals M. Thus, a complete rotation of the inner disc DI causes an Mth rotation of the outer disc DE. With such an operation, given that the outer disc DE comprises M symbols and that each of the M symbols is repeated on N consecutive angular sectors, the symbol of the inner disc DI displayed in the aperture GC remains the same, but the symbol of the outer disc DE displayed in the aperture GC changes. Upon each complete revolution of the inner disc DI, the symbol of the outer disc DE that can be seen through the aperture GC is modified.

Moreover, an Nth revolution of the inner disc DI causes a change in the symbol of the inner disc DI displayed in the aperture GC without modifying the symbol of the outer disc DE displayed in the aperture GC. This is the case except, of course, in the case whereby the angular sector of the outer disc DE that can be seen through the aperture GC is the last of a series of N angular sectors bearing the same symbol. In this case, the visible symbol of the inner disc DI and the visible symbol of the outer disc DE both change.

Figure 2:
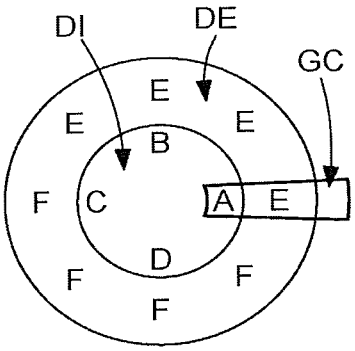
- FIG. 2 is a top view of the discs and the aperture of the device of FIG. 1, according to a first embodiment

FIG. 2 shows an example in which N=4 and M=2. The inner disc DI bears 4 symbols A, B, C, D; the outer disc DE bears 2 symbols E, F. Clearly, there is nothing preventing one or more of these symbols from being a void Ø.

In an initial position of the discs DI, DE shown in FIG. 2, the combination A E is displayed in the aperture GC. As the inner disc DI rotates, the following combinations are displayed:

B E-C E-D E-A F-B F-C F-D F-A E again, etc.

Figure 3:
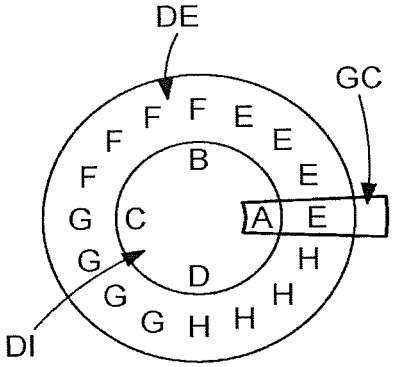
- FIG. 3 is a top view of the discs and the aperture of the device of FIG. 1, according to a second embodiment

Another example is provided in FIG. 3, in which N=4 and M=4. The inner disc DI bears 4 symbols A, B, C, D; the outer disc DE bears 4 symbols E, F, G, H. Again, there is nothing preventing one or more of these symbols from being a void Ø.

In an initial position of the discs shown in FIG. 3, the combination A E is displayed in the aperture. As the inner disc rotates, the following combinations are displayed:

B E-C E-D E-A F-B F-C F-D F-A G-B G-C G-D G-A H-B H-C H-D H-A E again, etc.

Of course, the higher the values of N and M, the larger the outer disc DE has to be, thus increasing the spatial requirement of the device, and/or the smaller the symbols on the outer disc DE have to be, which affects readability. For example, when N=3 and M=4, the outer disc DE must be divided into 12 angular sectors. If a 6 millimeter radius is desired for the outer disc DE, a height of 3.1 millimetres is available for inscribing the symbols.

Figure 4:
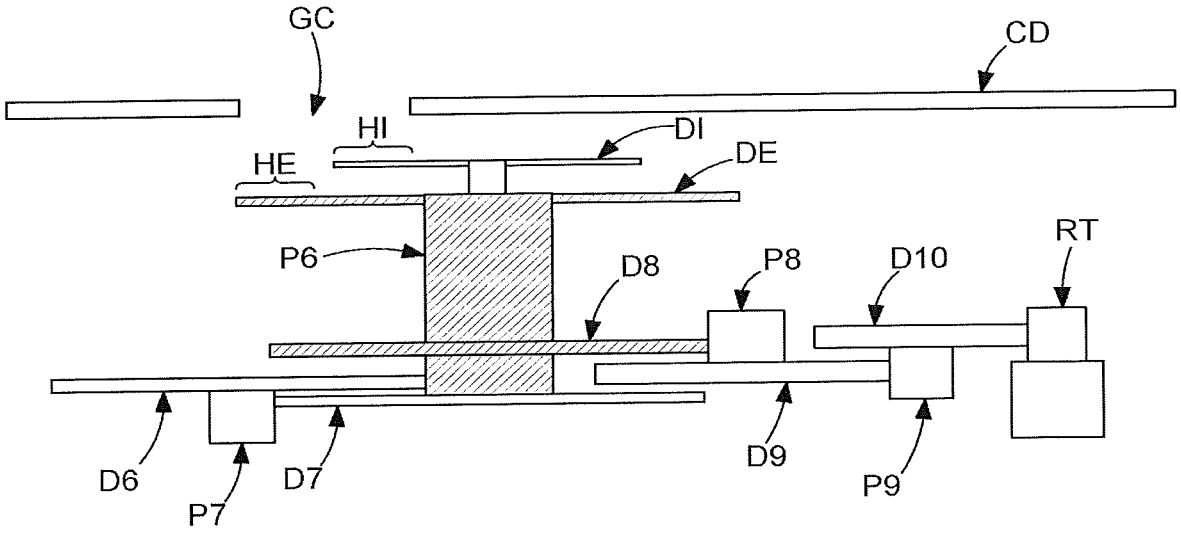
- FIG. 4 is a side view of the device for selecting a combination of patterns, according to the second aspect of the invention.

In an alternative embodiment shown in FIG. 4 and corresponding to a second aspect of the invention, the activation means drive the outer disc DE instead of driving the inner disc DI. The means for activating the inner disc DI then comprise, for example, an operable rod (not shown), a disc D6 that can be driven by the rod and a pinion P6 meshing with the disc D6 and constrained to rotate with the outer disc DE.

In the event that the activation means drive the outer disc DE, a speed increasing ratio M needs to be established between the outer disc DE (driving) and the inner disc DI (driven). The meshing means comprise, for example, the pinion P6, the disc D6, a pinion P7 constrained to rotate with the disc D6 and a disc D7 meshing with the pinion P7 and constrained to rotate with the inner disc DI.

Furthermore, the outer disc DE of the selection device is connected, via a chain comprising discs and pinions, to the rotor RT. The chain comprises, for example, the pinion P6, a disc D8 constrained to rotate with the pinion P6, a pinion P8 meshing with the disc D8, a disc D9 constrained to rotate with the pinion P8, a pinion P9 meshing with the disc D9 and a disc D10 constrained to rotate with the pinion P9.

However, except for these differences, the operating principle remains unchanged compared to the first aspect of the invention.

The invention also relates to a timepiece, not shown in the figures, the timepiece comprising a device for selecting patterns as previously described, and which can operate according to the first aspect or to the second aspect of the invention. In particular, the timepiece can be a payment watch in which the selection device allows payment means to be selected. The patterns, for example, are patterns of the bank card type (Visa, MasterCard or other), borne, for example, by the inner disc, and bank account patterns, of the purchase or currency type, from which the payment is made, borne by the outer disc, for example. Thus, the watch wearer selects the card and the account or the currency they want to use to pay by matching the corresponding patterns of each disc in the aperture of the dial.

The selection device is connected, for example, to a payment system integrated in the payment watch, the system not being shown on the drawings. Thus, the watch wearer selects patterns using the selection device and activates the payment via the integrated payment system, which transmits bank data to a bank payment terminal, for example.

In a first particular embodiment, the selection device comprises encoding means arranged under the inner and outer discs to transmit the selection information to the payment system. The encoding means are, for example, optical or capacitive means configured to determine the position of the discs, and therefore the patterns selected by the user.

In a second particular embodiment, the selection device comprises a processing unit, for example, provided with software, configured to count the rotation commands transmitted to the selection device when the user activates the selection device. Thus, the processing unit is capable of deducing the positions of the discs and therefore the patterns selected by the user.

Of course, the present invention is not limited to the example shown, but can undergo various variations and modifications that will become apparent to a person skilled in the art. In particular, the selection device can be used in other fields, with the payment watch being only one possible example of use.

The invention claimed is:

1. A device for selecting a combination of patterns, comprising:

a first disc, called an inner disc, the inner disc comprising N angular sectors of the same size, each of the N angular sectors bearing a symbol on its periphery, the symbol being defined as a pattern or a lack of a pattern, with N being a whole number greater than 1;

a second disc, called an outer disc, coaxial to the inner disc and having a larger diameter than the inner disc, the outer disc bearing M symbols distributed over M*N angular sectors of the same size, with M being a whole number greater than 1, each of the M symbols of the outer disc being repeated on N consecutive sectors of the outer disc;

a dial extending opposite the inner disc, the dial comprising an aperture allowing a pattern of the inner disc to be matched with a pattern of the outer disc;

activation means allowing the inner disc to be set into rotation; and meshing means coupling the inner disc and the outer disc according to a speed reducing ratio M.

2. The device according to claim 1, wherein N equals at most 5.

3. The device according to claim 2, wherein N equals at most two.

4. The device according to claim 2, wherein N equals at most three.

5. The device according to claim 1, wherein M equals at most 5.

6. The device according to claim 2, wherein M equals at most two.

7. The device according to claim 2, wherein M equals at most three.

8. The device according to claim 1, wherein the N symbols of the inner disc and the M symbols of the outer disc are all different.

9. The device according to claim 1, wherein the symbols of the inner disc and the symbols of the outer disc each form a half-image, with a symbol of the inner disc facing a symbol of the outer disc forming a complete image.

10. The device according to claim 1, comprising a single motor for together activating the inner and outer discs via the meshing means and the activation means.

11. A timepiece comprising a device for selecting a combination of patterns according to claim 1.

12. A device for selecting a combination of patterns, comprising:

a first disc, called an inner disc, the inner disc comprising N angular sectors of the same size, each of the N angular sectors bearing a symbol on its periphery, all the symbol being defined as a pattern or a lack of a pattern, with N being a whole number greater than 1;

a second disc, called an outer disc, coaxial to the inner disc and having a larger diameter than the inner disc, the outer disc bearing M symbols distributed over M*N angular sectors of the same size, with M being a whole number greater than 1, each of the M symbols of the outer disc being repeated on N consecutive sectors of the outer disc;

a dial extending opposite the inner disc, the dial comprising an aperture allowing a pattern of the inner disc to be matched with a pattern of the outer disc;

activation means allowing the outer disc to be set into rotation; and meshing means coupling the inner disc and the outer disc according to a speed increasing ratio M.

13. A timepiece comprising a device for selecting a combination of patterns according to claim 12.

* * * * *